US006009932A

United States Patent [19]

Smith

[11] Patent Number: 6,009,932

[45] **Date of Patent: *Jan. 4, 2000**

[54] PUSH TO EXIT, PULL TO ENTER LATCH ASSEMBLY FOR SCREEN DOOR

[75] Inventor: Mark L. Smith, Niles, Mich.

[73] Assignee: Atwood Industries, Inc., Rochester Hills, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/963,935

[22] Filed: Nov. 4, 1997

[51] Int. Cl.[7] ..... A47G 5/00

[52] U.S. Cl. ..... 160/371; 160/96; 160/180; 49/394; 292/166

[58] Field of Search ..... 49/394, 327, 163; 292/174, 175, 177, 166, 145, 35, 41, 42; 160/96, 180, 371, DIG. 2, DIG. 12

[56] References Cited

U.S. PATENT DOCUMENTS

| | | | |
|---|---|---|---|
| 2,504,483 | 4/1950 | Abraham | 292/174 |
| 3,024,837 | 3/1962 | McPhail | 49/163 |
| 3,043,617 | 7/1962 | Shelton | 49/394 |
| 3,249,379 | 5/1966 | Ross | 292/166 |
| 3,264,025 | 8/1966 | Hawes | 292/166 |
| 3,518,854 | 7/1970 | Krantz | 292/166 X |
| 3,722,237 | 3/1973 | Taylor . | |
| 3,909,051 | 9/1975 | Nakai | 292/166 |
| 4,094,099 | 6/1978 | Birch . | |
| 4,643,469 | 2/1987 | Johnston et al. . | |
| 4,751,766 | 6/1988 | Fahs et al. . | |
| 4,767,139 | 8/1988 | Hansing . | |
| 4,784,416 | 11/1988 | Crown et al. . | |
| 4,793,100 | 12/1988 | Harding et al. | 49/394 |
| 5,127,686 | 7/1992 | Gleason et al. . | |
| 5,192,097 | 3/1993 | Su | 292/166 |
| 5,257,839 | 11/1993 | Nielson et al. . | |
| 5,315,850 | 5/1994 | Edeus et al. . | |
| 5,484,176 | 1/1996 | Sallwasser | 292/137 |
| 5,535,550 | 7/1996 | Yang | 49/163 |
| 5,671,958 | 9/1997 | Szapucki et al. | 292/175 |
| 5,681,066 | 10/1997 | Anderson | 292/33 |
| 5,878,606 | 3/1999 | Chaput et al. | 70/108 |

*Primary Examiner*—David M. Purol
*Assistant Examiner*—Bruce A. Lev
*Attorney, Agent, or Firm*—Banner & Witcoff, Ltd.

[57] ABSTRACT

A push to exit, pull to enter latch assembly is disclosed, particularly suitable as a screen door latch for a recreational vehicle door assembly having a main closure door and a screen door. The latch assembly comprises a latch housing, a latch bolt linearly slidable from a latching position to an unlatching position, a push-to-release lever mounted on one side of the latch housing and a pull-to-release lever mounted on an opposite side of the latch housing. In certain preferred embodiments each release lever has a handle and a latch bolt engagement flange. Rotation of either release lever from its normal position to its releasing position forces the corresponding latch bolt engagement flange against the latch bolt, urging the latch bolt from the latching position to the unlatching position. The latch assembly may cooperate with a screen to close an opening in a pivotable screen door. Optionally a main door pivotable about the same axis as the screen door, is releasably attachable to the screen door at the latch assembly so that the main door and the screen door travel together between open and closed positions.

23 Claims, 4 Drawing Sheets

PUSH TO EXIT, PULL TO ENTER LATCH ASSEMBLY FOR SCREEN DOOR

FIELD OF THE INVENTION

The present invention relates generally to an improved latch assembly for a door assembly, and more particularly to a latch assembly for a screen door to close an opening.

BACKGROUND OF THE INVENTION

Latch assemblies are used, for example, on screen doors to secure the screen door to a frame and close an opening defined by the frame. The screen door has a screen door frame and a screen attached to the frame that allows the passage of air but not larger objects such as insects, etc. Optionally the screen door may have an opening closed by a sliding panel. The screen door may cooperate with a main closure door to provide the option of either shutting the main door or shutting only the screen door while leaving the main door open. The latch assembly secures the screen door to the frame while the main closure door remains open.

One example of a latch assembly for a screen door of a recreational vehicle is disclosed in U.S. Pat. No. 4,767,139 to Hansing. Hansing shows a latch bolt having an operator portion, typically operated by a single finger. Pulling on the operator portion in a direction parallel to the plane of the screen door slides the latch bolt from a latching position where it engages a latch keeper and secures the screen door to the frame of the recreation vehicle to an unlatching position where the screen door is free to pivot. Hansing also discloses a retainer mounted on the main closure door having a pair of latch bolt engaging portions. The latch bolt engaging portions engage the latch bolt to secure the screen door to the main door so that the doors travel together. Other mechanisms for retaining a screen door together with a main closure door are known, such as magnets and velcro strips.

Known latch assemblies used for recreational vehicles have several problems. Typically the latch assembly is mounted on an inside surface of the screen door. Thus an access port or opening (typically closable by a sliding panel) must be provided to access the latch assembly from the outside, and an operator must awkwardly reach around the opening to operate the latch assembly. Further, multiple steps are required to open the door from the inside. First, an operator must pull the latch bolt in a direction generally parallel to the plane of the screen door. Second, the operator has to push or pull on the screen door in a direction generally perpendicular to the screen door to open the screen door. It would be desirable to be able to access the latch assembly from either the inside or the outside of the screen door without having to operate a sliding panel. It would also be desirable for an operator to use one motion to disengage the latch assembly from the frame of the motor vehicle and pivot the screen door open.

In view of the foregoing, it is an object of the present invention to provide a latch assembly of simple construction for a screen door pivotable from a closed position to an open position which is accessible from both sides of the screen door without necessarily reaching through an opening or moving a sliding panel. It is an additional object of the present invention to provide a latch assembly that is engagable such that the directional force required to disengage the latch assembly is in the same direction as the directional force required to move the screen door from the closed position.

It is an additional object of the present invention, at least in preferred embodiments, to provide a door assembly for a recreational vehicle having a screen door and a latch assembly wherein the latch assembly cooperates with a screen to close an opening in the screen door. It is yet another related object of the present invention to provide such a door assembly that is highly reliable in operation. Additional objects will be apparent to those skilled in the art given the benefit of this disclosure.

SUMMARY OF THE INVENTION

In accordance with these and other objects, there is provided a latch assembly which comprises a latch housing, a latch bolt mounted at least in part in the latch housing and being axially slidable from a latching position to an unlatching position, a push-to-release lever mounted to one side of the latch housing and a pull-to-release lever mounted to an opposite side of the latch housing. The push-to-release lever has a first latch bolt engagement flange and the pull-to-release lever has a second latch bolt engagement flange. Rotation of the push-to-release lever moves the first latch bolt flange against the latch bolt, and so moves the launch bolt to the unlatching position. Similarly, rotation of the pull-to-release lever moves the second latch bolt flange against the latch bolt which in turn urges the latch bolt to the unlatching position. The latch assembly may be attached to a door, such as a screen door for a recreational vehicle which is pivotably mounted about an axis between an open position to a closed position.

Advantageously the latch bolt can be moved to the unlatching position from either side of the latch assembly, and consequently, from either side of the screen door. Moreover, pushing against the push-to-release lever to move the latch bolt to the unlatching position also serves to push the screen door toward the open position. Similarly, pulling on the pull-to-release lever, which is mounted on the opposite side of the screen door, serves to simultaneously pull the latch bolt to the unlatching position and urge the screen door toward the open position.

From the foregoing disclosure and the following more detailed description of various preferred embodiments it will be apparent to those skilled in the art that the present invention provides a significant advance in the technology and art of latch assemblies, especially latch assemblies for screen doors. Particularly significant in this regard is the potential the invention affords for easy access through an opening from either of two opposite directions with an advantageous design. Additional features and advantages of various preferred embodiments will be better understood in view of the detailed description provided below.

Figure 1:
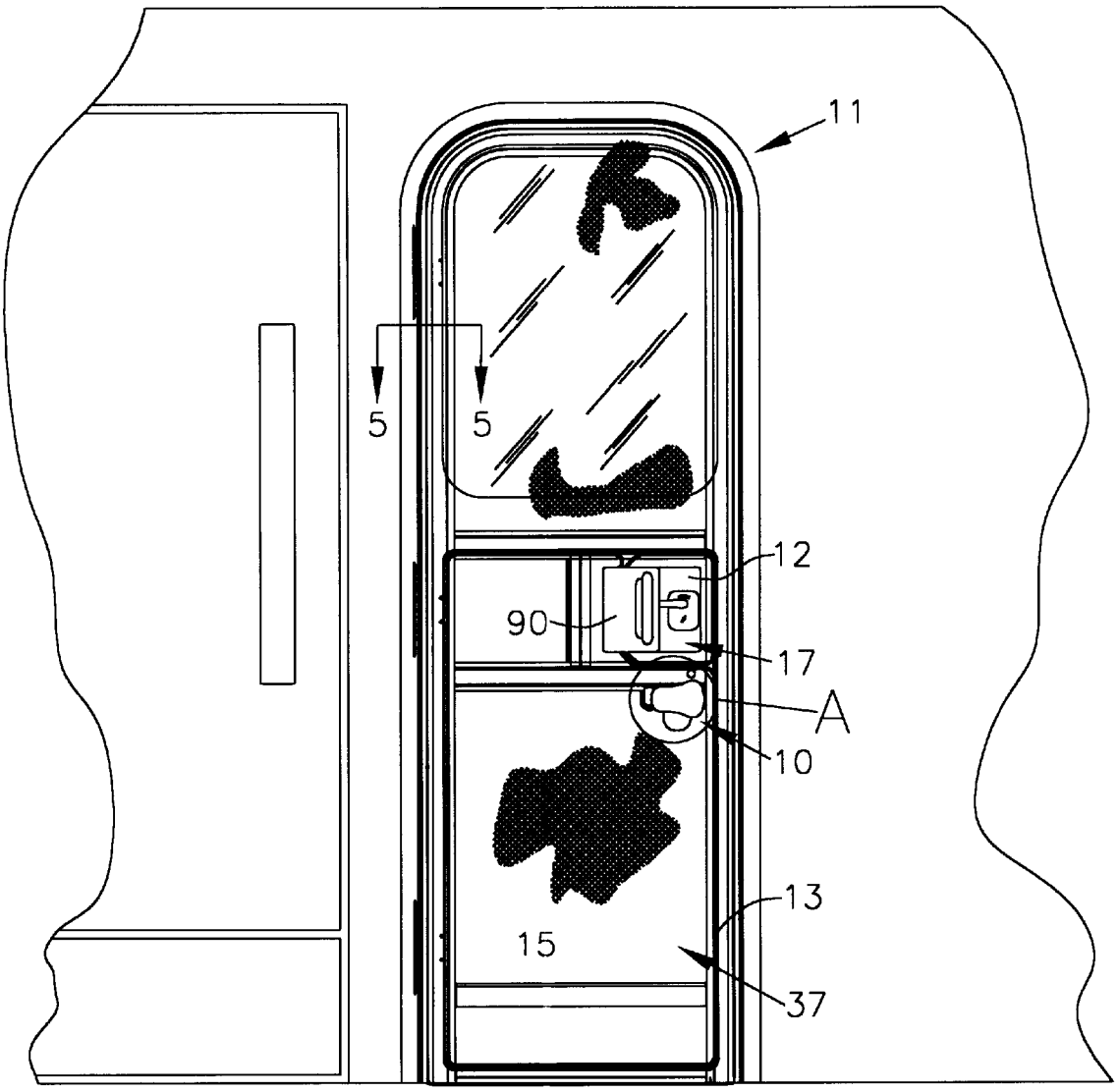
FIG. 1 is a view of a door assembly taken from the inside or inboard side, showing a main closure door and a screen door in accordance with a preferred embodiment.

It should be understood that the appended drawings are not necessarily to scale, presenting a somewhat simplified representation of various preferred features illustrative of the basic principles of the invention. The specific design features of a latch assembly for a screen door as disclosed here, including, for example, the cross sectional thickness of the release levers and the latch keeper, and the specific dimensions of the latch bolt catch and latch hook will be determined in part by the particular intended application and use environment. Certain features of the illustrated embodiments have been enlarged or distorted relative to others to facilitate visualization and clear understanding. In particular, thin features may be thickened, for clarity of illustration. All references to direction and position, unless otherwise indicated, refer to the orientation of the latch assembly illustrated in the drawings. In general, inboard-outboard or inside-outside refers to a plane normal to the plane of the paper in FIG. 1, and up, down or vertical refers to corresponding up, down and vertical directions in the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the push-to-exit, pull-to-enter latch assembly disclosed herein. The following detailed discussion of various alternative and preferred features and embodiments will illustrate the general principles of the invention with reference to a latch assembly integrated into a screen door for a motor vehicle door, especially a recreational vehicle, although the principles of the invention will be applicable to other doors having a latch assembly installed therein.

Referring now to the drawings, FIGS. 1–5 show a door assembly 11 such as would be used in a recreational vehicle comprising a main closure door 12 and a screen door 13. The main door 12 and the screen door 13 are connected by a bracket 18 so that they can pivot together on the same hinge 19, shown best in FIG. 5. Preferably both doors arc pivotable from closed positions to open positions and either door in the closed position may close an opening in a vehicle defined by vehicle frame 14. Additionally, the screen door 13 can be secured to the main door 12 so that the doors pivot together between open and closed positions. Alternatively, the screen door can be disengaged from the main door so that the main door can be swung outward to an open position while the screen door remains in the closed position. This allows air passage into the motor vehicle but restricts entry of insects or other larger objects.

The main door 12 is preferably positioned along an outboard side of the screen door 13. A first opening 17 in the screen door permits access to the main door 12 from the inboard side through the screen door. The screen door 13 may be provided with a sliding panel 90 slidable from an open position to a closed position where the panel closes the opening 17.

Figure 3:
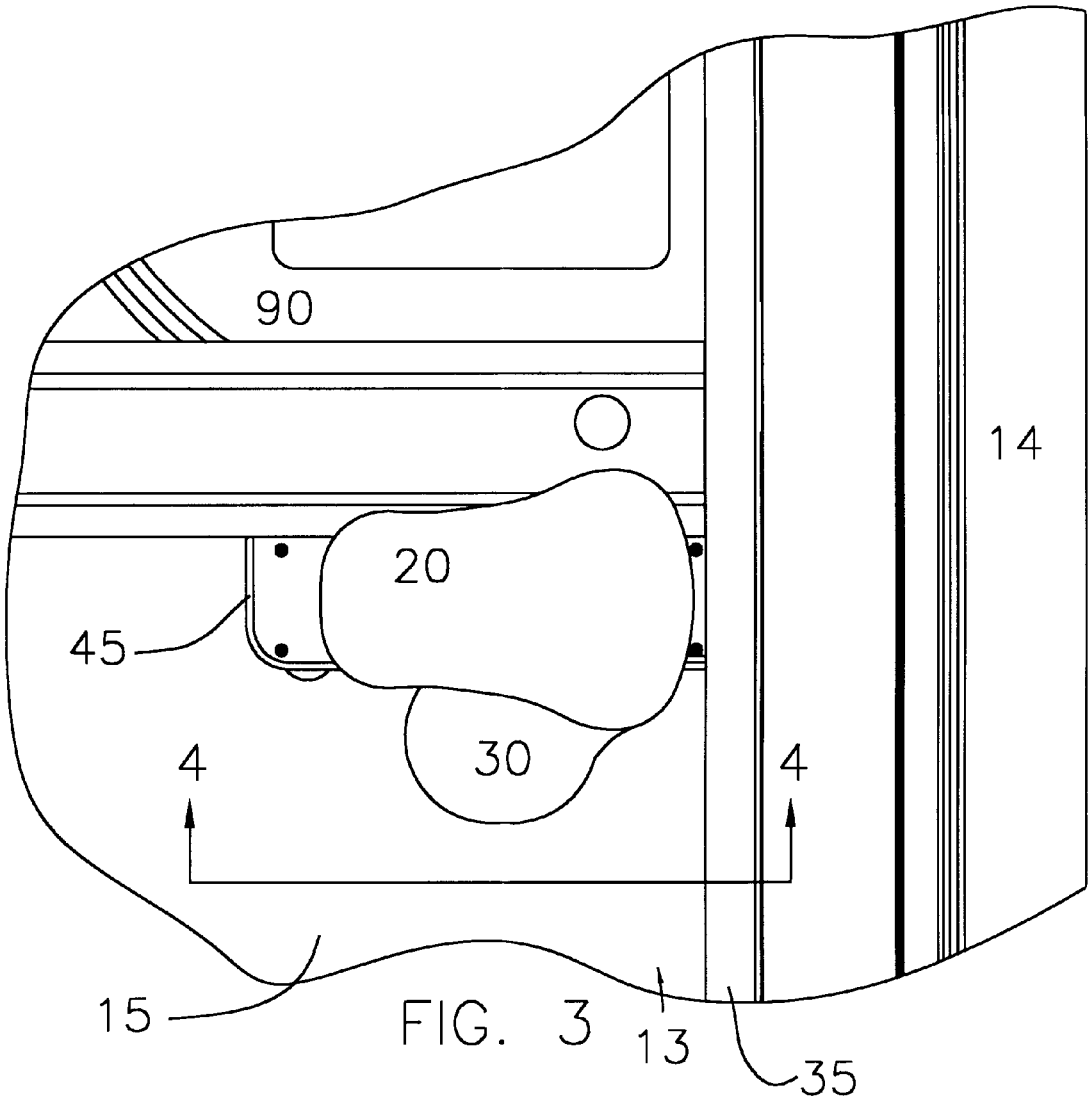
FIG. 3 is a partially cut away inside view of the screen door taken from section A in FIG. 1, showing the push-to-exit lever of the latch assembly.

FIG. 3 shows a latch assembly 10 in an assembled condition where the screen door 13 is in the closed position. The latch assembly latches the screen door to the door frame 14, releasably securing the screen door in the closed position shown in FIG. 3. In accordance with a highly advantageous feature the latch assembly cooperates with a screen 15 to close a second opening 37 of the screen door defined by the screen door frame 35. Closed, as used here, simply means that the screen prevents access of insects or large dirt particles to the inside of the motor vehicle. Screen 15 is attached directly to the latch assembly 10 at groove 45, and the latch assembly is attached to the screen door frame 35 with screws, rivets or other suitable fastening devices.

Figure 2:
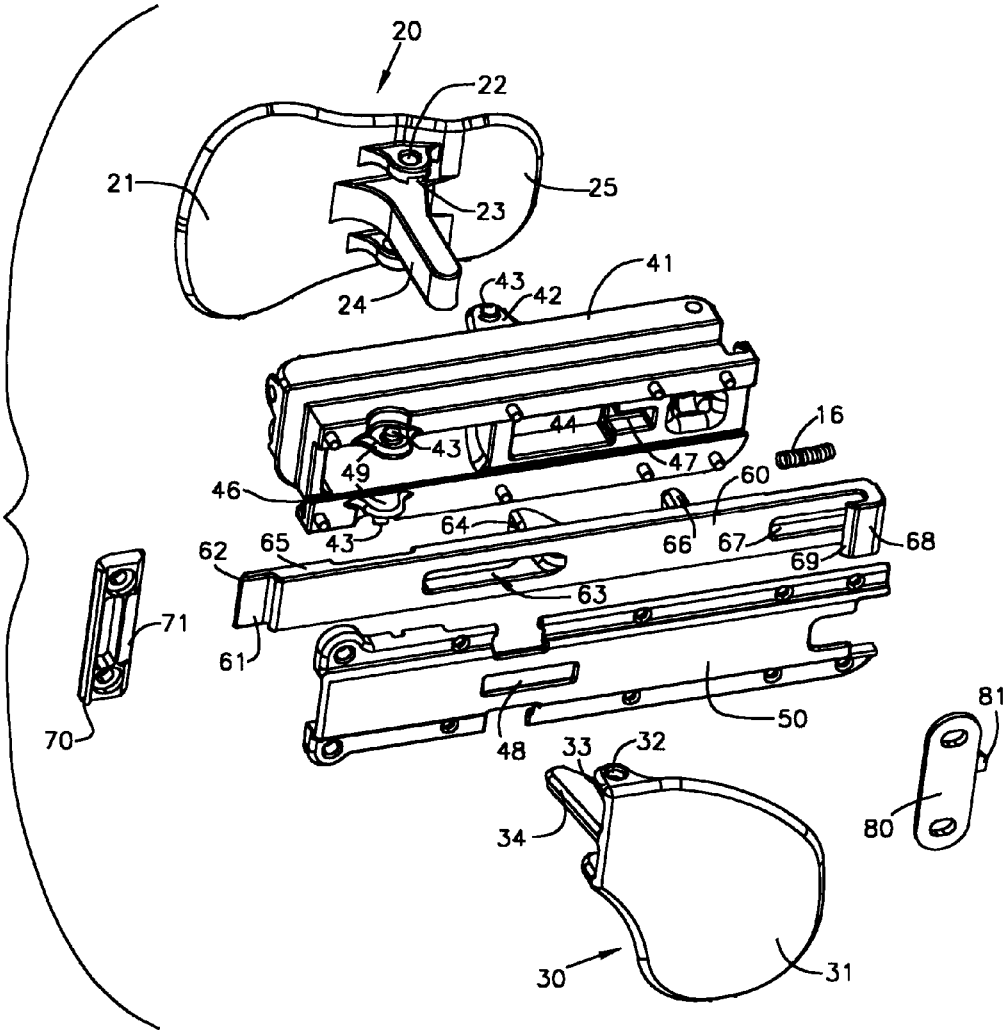
FIG. 2 is an exploded perspective view of the latch assembly of the embodiment of FIG. 1.

FIG. 2 shows an exploded perspective view of the latch assembly 10 to better illustrate the internal components and workings. The latch assembly 10 has a latch housing 40 comprising a main body 41 and a cover plate 50. A latch bolt 60 is mounted within the latch housing 40 and is axially slidable from a latching position to an unlatching position. The main body 41 has a mount 42 extending from an inboard side. The mount receives a push-to-release exit lever 20 pivotable from a first, normal position to a first releasing position. The push-to-release lever 20 has a push handle 21 and finger catch 25 positioned on opposite sides of and inboard from a latch bolt engagement flange 24. The push-to-release lever 20 is preferably hingedly attached to the mount 42, and optionally may have beveled surfaces allowing for pivotable snap fit attachment over cars 43. The latch bolt engagement flange 24 of the push-to-release lever extends through an opening 44 in the main body 41 of the latch housing into contact with a first projection 64 of the latch bolt. A spring 16 is positioned between the first projection 64 and the main body 41, biasing the latch bolt toward the latching position. The first projection may extend into the opening 44. A pushing force on the release lever handle 21 rotates the push-to-release lever to the releasing position. This force urges the latch bolt engagement flange against the first projection 64, overcoming the force of the spring 16 on the first projection and sliding the latch bolt 60 to the unlatching position.

A pull-to-release lever 30 is pivotably mounted on the outboard side of the latch assembly on cover plate 50, optionally by a snap fit feature similar to that described for the push-to-release lever and the main body, including beveled surfaces 23 allowing ears 43 extending from projections 42 to rotatably captivate the pull-to-release lever. The pull-to-release lever 30 is pivotable between a second normal position and a second releasing position by pulling on a second handle 31. A second latch bolt engagement flange 34 extends through opening 48 and slot 63 in the latch bolt 60 into contact with a second latch bolt projection 66. Pulling on the pull-to-release lever 30 from the normal position toward the second releasing position urges the second latch bolt engagement flange 34 into contact with the second latch bolt projection 66, which overcomes the force of the spring 16 and urges the latch bolt 60 from the latching condition to the unlatching position. As the latch bolt projections 64, 66 are positioned separate from one another on the latch bolt 60, operation of the push-to-release lever does not affect the pull-to-release lever, and vice versa. Release of either release lever allows the force of the spring to return the latch bolt to the latching position.

In the preferred embodiment shown in the drawings the latch assembly is mounted below the sliding panel 90, with release levers 20, 30 positioned on the inboard side and outboard side, respectively. Thus, when the main door is open but the screen door is closed, the sliding panel 90 does not need to be moved to an open position to open the screen door 13.

For ease of assembly, the latch bolt 60 may be slidably snap fit to the main body 41 of the latch housing 40. Once the latch bolt 60 is attached to the latch housing by snap fit, the latch bolt is linearly slidable with respect to the latch housing. The latch bolt is semi-rigid, that is, the latch bolt has flexible angled surfaces 65 sufficiently resilient to snap fit past flexible angled surfaces 46 extending from the main body toward the latch bolt and then return to an initial position.

When the latch bolt 60 is in the latching position and the screen door is in the closed position the latch bolt is captivated by latch bolt keeper 70 and vehicle door frame 14. Latch bolt keeper 70 may have a beveled surface 71 for engaging the beveled surface 62 of the latch bolt flange 61 to facilitate smooth sliding motion between latched and unlatched positions.

Advantageously, the screen door 13 may be releasably secured to the main door 12. As the screen door is pivoted toward the main door, projection 81 of latch bolt catch 80 mounted on the main door 12 with screws or other suitable mounting mechanisms, releasably engages a beveled surface 69 of single hook 68 mounted on the latch bolt 60. As the beveled surface 82 of the projection 81 moves into contact with the hook 68, the projection extends into slot 67 in the latch bolt 60 and the beveled surface of the projection urges the hook away from the latching position until the projection clears the beveled surface 69. Then the force of spring 16 urges the latch bolt back to the latching position so that the hook 68 and latch catch 80 are captivated together. Operation of push lever 20 allows the screen door to disengage the main door. The latch catch and hook allows the option of opening just the main door and leaving the screen door in a closed position or securing the screen door and the main door together so that both doors are either closed or opened at the same time.

Figure 4:
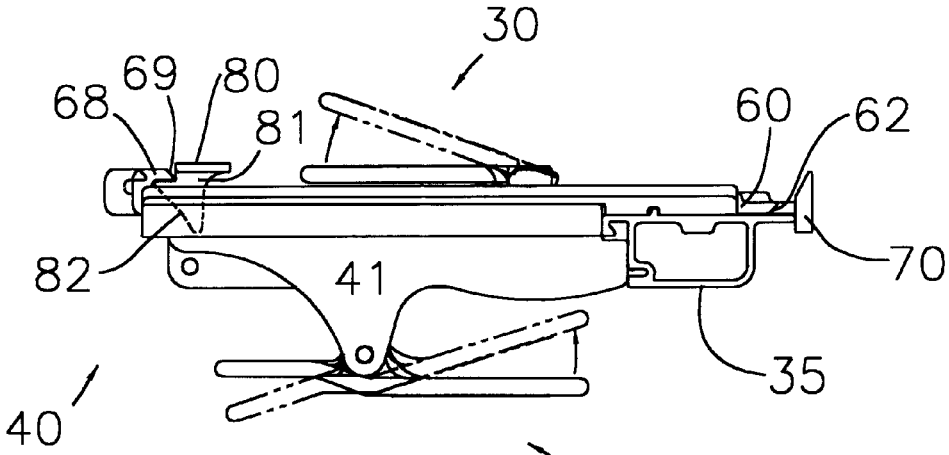
FIG. 4 is cross section view taken through line 4—4 in FIG. 3 showing the push-to-release exit lever and pull-to-release enter lever.
Figure 5:
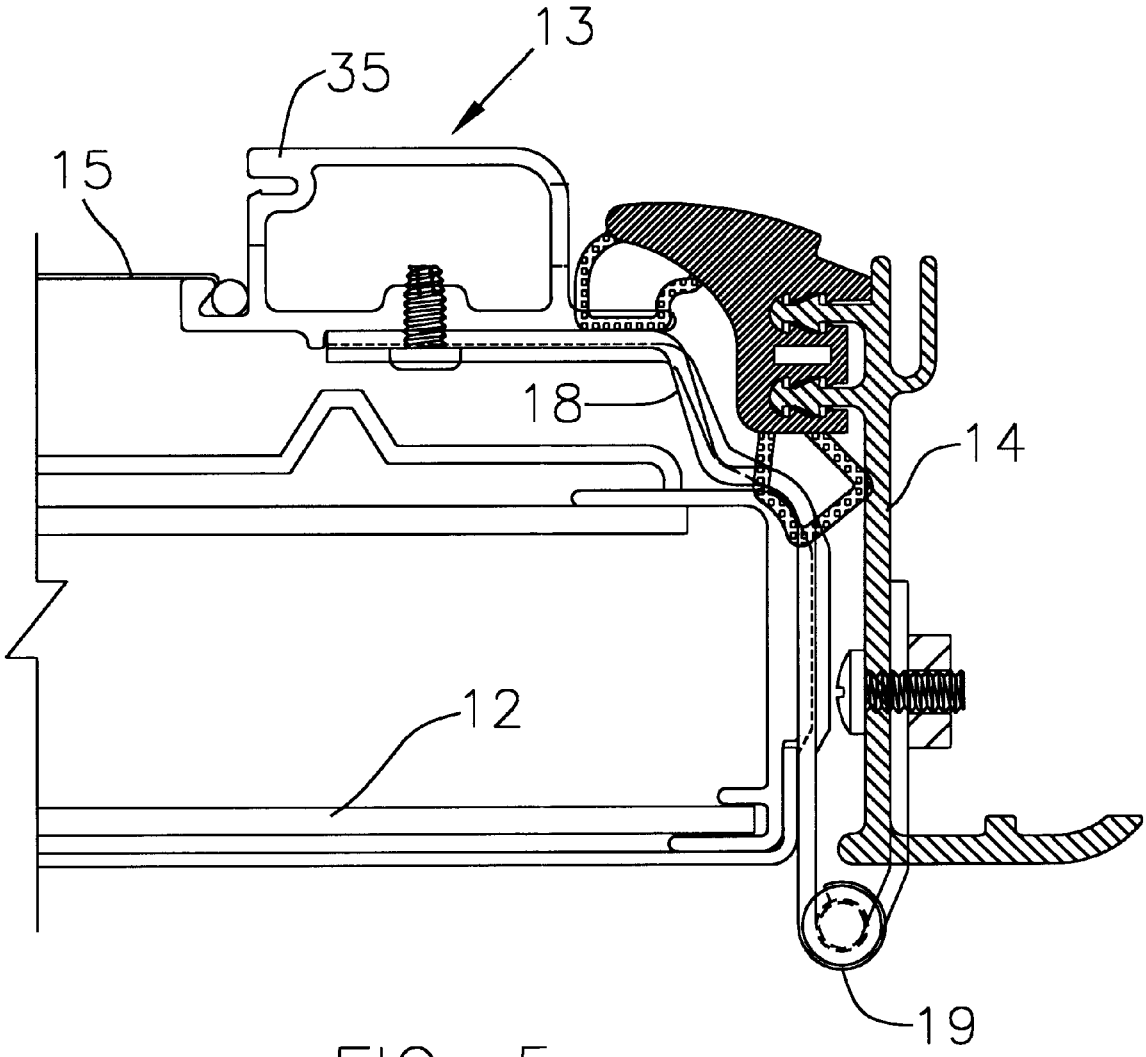
FIG. 5 is a cross section view taken along line 5—5 in FIG. 1, showing the screen door and main door pivotable about the same axis.

FIG. 4. is a top view of the latch assembly 10, showing the direction of motion of the release levers 20, 30. Pushing on the push-to-release lever handle 25 urges the latch bolt 60 out of engagement with the latch keeper 70. This action simultaneously places a force on the screen door urging the screen door to the opened position. Thus, a single motion act to both disengage the latch bolt and open the screen door. Similarly, the handle 31 on pull-to-release lever 30 acts to both disengage the latch bolt and pull open the screen door in a single motion.

From the foregoing disclosure and detailed description of certain preferred embodiments, it will be apparent that various modifications, additions and other alternative embodiments are possible without departing from the true scope and spirit of the invention. For example, a hinge pin could be substituted for the ears on the latch housing to enhance the strength at the pivot point of the release levers. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A latch assembly comprising, in combination:

a latch housing having an inboard side and an outboard side;

a latch bolt mounted to the latch housing, axially slidable from a latching position to an unlatching position, the latch bolt being provided with a slot, a first projection and a second projection;

a push-to-release lever rotatable from a first normal position to a first releasing position, mounted to the inboard side of the latch housing, having a first latch bolt engagement flange formed as a single piece with the push-to-release lever, wherein rotation of the push-to-release lever to the first releasing position moves the first latch bolt engagement flange against the first projection of the latch bolt which urges the latch bolt to thc unlatching position; and a pull-to-release lever rotatable from a second normal position to a second releasing position, mounted to the outboard side of the latch housing, having a second latch bolt engagement flange formed as a single piece with the pull-to-release lever, wherein rotation of the pull-to release lever to the second releasing position moves the second latch bolt engagement flange against the second projection of the latch bolt which urges the latch bolt to the unlatching position;

wherein the second latch bolt engagement flange extends through the slot.

2. The latch assembly of claim 1 wherein a spring is positioned between the latch housing and the latch bolt, biasing the latch bolt toward the latching position.

3. The latch assembly of claim 1 wherein the push-to-release lever is pivotably secured to the latch housing by snap fit, and the pull-to-release lever is pivotably secured to the latch housing by snap fit.

4. The latch assembly of claim 1 further comprising a spring biasing the latch bolt toward the latching position, mounted between the latch housing and the first projection.

5. The latch assembly of claim 1 wherein the latch housing has an opening and the first latch bolt engagement flange extends through the opening.

6. The latch assembly of claim 1 further comprising a latch bolt keeper having a beveled surface, wherein the latch bolt has a latch flange with a beveled surface which is slidable past the latch bolt keeper beveled surface when the latch bolt slides from the unlatching position to the latching position.

7. The latch assembly of claim 1 wherein the latch bolt is slidably secured to the latch housing by snap fit.

8. The latch assembly of claim 7 wherein the latch bolt is a semi-rigid member having a beveled surface, and the latch housing has a projection which snap fits past the beveled surface to slidably secure the latch bolt to the latch housing.

9. The latch assembly of claim 1 wherein the latch housing comprises attachment means for securing the latch housing to a screen door.

10. The latch assembly of claim 1 wherein the latch housing has a screen mount groove for receiving a peripheral edge of a screen.

11. The latch assembly of claim 1 further comprising:

a latch bolt hook mounted on one end of the latch bolt; and a latch bolt catch comprising:

engagement means for releasably engaging the latch bolt hook in an engaging position, for movement in fixed relative position to the latch bolt, and mounting means for mounting the latch bolt catch to a support structure for pivoting movement between the engaging position and a non-engaging position.

12. The latch assembly of claim 11 wherein the engagement means comprises a latch bolt catch having a projection with a beveled surface which engages a beveled surface on the latch bolt, wherein the projection extends into a latch catch slot and the beveled surface of the latch bolt catch engages the beveled surface of the latch bolt, urging the latch bolt to the unlatching position until the beveled surfaces clear one another, allowing the latch bolt to return to the latching position.

13. The latch assembly of claim 1 further comprising a first handle formed unitary with the first latch bolt engagement flange, and a second handle formed unitary with the second latch bolt engagement flange.

14. The latch assembly of claim 1 wherein the push-to-release lever is rotatable to the first releasing position without urging the pull-to-release lever to the second releasing position, and the pull-to-release lever is rotatable to the second releasing position without urging the push-to-release lever to the first releasing position.

15. A door assembly comprising, in combination:

a screen door pivotable about an axis from an closed position to an open position, comprising a screen door frame defining a first opening and a second opening, and a screen mounted in the screen door frame; and a latch assembly mounted to the screen door frame, wherein the screen cooperates with the latch assembly to close the second opening, the latch assembly comprising;

a latch housing having an inboard side and an outboard side;

a latch bolt mounted to the latch housing and axially slidable from a latching position to an unlatching position;

a single spring mounted between the latch housing and the latch bolt, biasing the latch bolt towards the latching position;

a push-to-release lever mounted to the inboard side of the latch housing, biased by the spring toward a first normal position and rotatable to a first releasing position, wherein rotation of the push-to-release lever toward the first releasing position moves both the latch bolt toward the unlatching position and the screen door toward the open position, and the screen door stays in the closed position until the latch bolt is in the unlatching position; and a pull-to-release lever mounted to the outboard side of the latch housing, biased by the spring toward a second normal position and rotatable to a second releasing position, wherein rotation of the pull-to-release lever to the second releasing position moves both the latch bolt toward the unlatching position and the screen door toward the open position, and the screen door stays in the closed position until the latch bolt is in the unlatching position.

16. The door assembly of claim 15 wherein the latch assembly further comprises a screen mount groove, and the screen is attached to the latch assembly at the screen mount groove.

17. The door assembly of claim 15 further comprising a sliding panel mounted on the screen door frame, slidable between an open position and a closed position, and closing the first opening in the closed position.

18. The door assembly of claim 15 further comprising a main door attached to the screen door and pivotable about the same axis as the screen door.

19. The door assembly of claim 18 wherein the latch bolt has a hook and the main door has a latch bolt catch, and the latch bolt catch engages the hook in an engaging position, securing the screen door to the main door for pivoting movement together.

20. The door assembly of claim 15 wherein as the push-to-release lever moves toward the first releasing position the push-to-release lever pivots about an axis perpendicular to the direction of sliding motion of the latch bolt, and as the pull-to-release lever moves toward the second releasing position the pull-to-release lever pivots about an axis perpendicular to the direction of sliding motion of the latch bolt and opposite the direction of motion of the push-to-release lever pivoting towards the first releasing position.

21. The door assembly of claim 15 further comprising a latch keeper mountable to a frame of a motor vehicle, releasably engaging the latch bolt in the latching position to hold the screen door in the closed position.

22. A door assembly comprising, in combination:

a main door;

a screen door pivotable about an axis from a first position to a second position, the screen door comprising a screen door frame defining a first opening and a second opening separate from the first opening, and a screen mounted in the screen door frame, wherein the main door is accessible through the first opening;

a sliding panel mounted on the screen door frame, slidable from an open position to a closed position where the main door is not accessible, the sliding panel closing the first opening in the closed position; and a latch assembly mounted to the screen door frame and mounted to the screen, wherein the screen cooperates with the latch assembly to close the second opening, the latch assembly comprising:

a latch housing having an inboard side and an outboard side;

a latch bolt mounted to the latch housing and axially slidable from a latching position to an unlatching position;

a push-to-release lever mounted to the inboard side of the latch housing, rotatable between a first normal position and a first releasing position, wherein rotation of the push-to-release lever toward the first releasing position moves both the latch bolt toward the unlatching position and the screen door toward the open position, and the screen door stays in the closed position until the latch bolt is in the unlatching position; and a pull-to-release lever mounted to the outboard side of the latch housing, rotatable between a second normal position and a second releasing position, wherein rotation of the pull-to-release lever to the second releasing position moves both the latch bolt toward the unlatching position and the screen door toward the open position, and the screen door stays in the closed position until the latch bolt is in the unlatching position.

23. A door assembly comprising, in combination:

a main door pivotable about a first axis and mounted to a vehicle door frame;

a screen door pivotable about the first axis from a closed position to an open position; and a latch assembly mounted to the screen door frame, the latch assembly comprising:

a latch housing having an inboard side and an outboard side;

a latch bolt having a latch bolt hook mounted on one end, and a latch bolt flange mounted on a second end of the latch bolt opposite the first end, the latch bolt being mounted to the latch housing and axially slidable from a latching position to an unlatching position, the latch bolt flange adapted to releasably secure the screen door to the vehicle door frame in the latching position;

a latch bolt catch mounted on the main door, releasably receiving the latch bolt hook in the latching position, wherein when the latch bolt hook engages the latch bolt catch the screen door is releasably secured to the main door so that the screen door is pivotable with the main door;

a push-to-release lever mounted to the inboard side of the latch housing, rotatable between a first normal position and a first releasing position, wherein rotation of the push-to-release lever toward the first releasing position moves both the latch bolt toward the unlatching position and the screen door toward the open position, and the screen door stays in the closed position until the latch bolt is in the unlatching position; and a pull-to-release lever mounted to the outboard side of the latch housing, rotatable between a second normal position and a second releasing position, wherein rotation of the pull-to-release lever to the second releasing position moves both the latch bolt toward the unlatching position and the screen door toward the open position, and the screen door stays in the closed position until the latch bolt is in the unlatching position.

* * * * *